US005778573A

United States Patent [19]

Nottingham et al.

[11] Patent Number: 5,778,573

[45] Date of Patent: Jul. 14, 1998

[54] TWO-WAY SWIVEL BRACKET WITH IRONING BOARD ASSEMBLY

[75] Inventors: John R. Nottingham, Hunting Valley; John W. Spirk, Gates Mills; Richard O. McCarthy, Strongsville; Nicholas E. Stanca, Westlake; Jeffery M. Kalman, Cleveland Heights, all of Ohio

[73] Assignee: Whitney Designs, Inc., St. Louis, Mo.

[21] Appl. No.: 782,884

[22] Filed: Jan. 10, 1997

[51] Int. Cl.[6] ..... D06F 81/06; A47B 96/18

[52] U.S. Cl. ..... 38/103; 108/42; 248/73; 248/447.1; 38/104; 38/137

[58] Field of Search ..... 38/103, 104, 137, 38/139, DIG. 1–DIG. 3; 108/4, 47, 48, 49, 117, 151; 248/441.1, 447.1, 447.2, 73, 65, 200.1, 223.1, 300, 315, 510; 24/457, 536, 538, 540

[56] References Cited

U.S. PATENT DOCUMENTS

| | | | |
|---|---|---|---|
| 523,355 | 7/1894 | Kinley et al. . | |
| 667,164 | 1/1901 | Carder . | |
| 920,343 | 5/1909 | Kelly et al. . | |
| 1,228,869 | 6/1917 | Anderson | 38/103 |
| 1,257,114 | 2/1918 | Potter et al. | 38/137 X |
| 1,506,240 | 8/1924 | Ives . | |
| 1,558,409 | 10/1925 | Stienecker . | |
| 1,576,034 | 3/1926 | Butt . | |
| 1,696,145 | 12/1928 | Wagoner . | |
| 1,766,154 | 6/1930 | Triller . | |
| 1,843,391 | 2/1932 | Gayle . | |
| 1,868,185 | 7/1932 | Worley, Jr. et al. . | |
| 2,057,329 | 10/1936 | Duff . | |
| 2,236,717 | 4/1941 | Noack . | |
| 2,386,139 | 10/1945 | Rasmussen . | |
| 2,498,428 | 2/1950 | Kruse . | |
| 2,535,755 | 12/1950 | Rieter . | |
| 2,567,538 | 9/1951 | Anderson . | |
| 2,633,998 | 4/1953 | Derman . | |
| 2,743,023 | 4/1956 | Larson . | |
| 2,829,855 | 4/1958 | Gibson . | |
| 2,867,401 | 1/1959 | Sheahan . | |
| 2,925,916 | 2/1960 | Pollock . | |
| 2,959,297 | 11/1960 | Larson . | |
| 3,022,589 | 2/1962 | Kleinman | 38/104 |
| 3,129,676 | 4/1964 | Brooks et al. . | |
| 3,170,417 | 2/1965 | Avidiya . | |
| 3,245,161 | 4/1966 | Adiletta et al. . | |
| 3,536,287 | 10/1970 | Kramer . | |
| 3,663,080 | 5/1972 | Ayers . | |
| 3,680,235 | 8/1972 | Leemhuis . | |
| 3,965,588 | 6/1976 | Long . | |
| 4,247,020 | 1/1981 | Dirksing . | |
| 4,318,486 | 3/1982 | Bobrowski . | |
| 4,382,641 | 5/1983 | Abel . | |
| 4,480,556 | 11/1984 | Wison et al. | 38/103 X |
| 4,510,872 | 4/1985 | Parry . | |
| 4,657,249 | 4/1987 | Offutt . | |
| 4,862,611 | 9/1989 | Wright . | |
| 4,899,667 | 2/1990 | Miller et al. . | |
| 4,961,388 | 10/1990 | Simpson . | |
| 4,974,841 | 12/1990 | Jarriel et al. . | |
| 4,976,205 | 12/1990 | Miller et al. . | |
| 5,329,860 | 7/1994 | Mattesky . | |
| 5,452,531 | 9/1995 | Graville et al. | 38/104 |
| 5,483,761 | 1/1996 | Simpson . | |

FOREIGN PATENT DOCUMENTS

| | | | |
|---|---|---|---|
| 309142A | 3/1989 | European Pat. Off. . | |
| 687707 | 1/1930 | France | 38/103 |

*Primary Examiner*—Ismael Izaguirre

*Attorney, Agent, or Firm*—Middleton & Reutlinger; John F. Salazar

[57] ABSTRACT

A portable ironing board having a two-way swivel bracket assembly. The ironing board may be affixed to a dryer and stored in the space between a washing machine and dryer and is attached to the dryer by means of an attachment assembly. The attachment assembly allows secure affixing of the entire ironing board assembly to the top, side and bottom of the dryer. The ironing board additionally has a swivel assembly which allows the ironing board to be rotated about a first and a second axis. The first rotation allows the ironing board to be swiveled from a vertical stored position in which the ironing board is directed downwards to a vertical position wherein the ironing board extends outward toward the front of the dryer. The second rotation ability allows the ironing board to be swiveled about such that the ironing board rests upon the top of the dryer.

25 Claims, 13 Drawing Sheets

TWO-WAY SWIVEL BRACKET WITH IRONING BOARD ASSEMBLY

FIELD OF THE INVENTION

The present invention relates to a two-way swivel bracket assembly which is used for attaching an ironing board to the side of a standard sized washer or dryer. More particularly, the present invention relates to a portable ironing board assembly which has a two way swivel bracket and attachment arm for tightening the ironing board assembly onto the side of a dryer. The ironing board is storable in the area between the washer and dryer and swivels outward and pivots over onto the top of the dryer for use.

DISCUSSION OF THE PRIOR ART

Standard type ironing boards are well known in the art. They are typically very large items usually made of a metal structure and foldable or collapsible for storage within a closet. However, the ease of use of these ironing boards is fairly limited when available space is limited or when there is lack of storage space for the entire collapsible ironing board. There has not been heretofore an ironing board assembly which is storable in a small or limited space but which is easily accessible and requires relatively little assembly required for use. This problem has continued due to the inability to accommodate the attachment of an ironing board to small objects while also allowing the attachment of the ironing board to swivel and pivot allowing the ironing board to be stored away in a narrow storage space. Further, there has been additional problems in attachment brackets which allow such an ironing board to be portable yet also allowing the ironing board to be securely attached to the side of a dryer.

Certain portable type ironing boards are known such as that shown in U.S. Pat. No. 4,862,611 wherein a portable ironing board is shown which allows attachment of the ironing board assembly to the top edge of a door. However, the ironing board is pivotable only about a single direction and may not be utilized within an area bounded on both sides by an immovable object. Additionally, this patent shows an attachment bracket which will only work on the top edge of a door. Also known is the ironing board shown in U.S. Pat. No. 2,386,139 wherein a portable ironing board which attaches to a door knob is shown. The ironing board merely has a bracket attachment for wrapping around the door knob and a lower stabilizing bar for support of the center section of the ironing board. However, none of these prior art devices enable an ironing board to be stored in a narrow space while also allowing the ironing board to be swiveled outward from said narrow space and pivoted to the top of a stable work area.

SUMMARY OF THE INVENTION

The present invention is for a two-way swivel bracket with an ironing board assembly which allows the ironing board to be mounted onto a dryer and stored in the narrow space between the washing machine and dryer. The two-way swivel attachment bracket allows the ironing board to be swiveled outward from the limited space between the washer and dryer while also allowing the ironing board, once swiveled outside this narrow space, to be pivoted over onto the top of the dryer for use.

One object of the present invention is to provide a portable ironing board which is storable within a very narrow lateral space and which may be securely attached to the side of a small stable object.

Another object of the present invention is to provide a portable ironing board which has a two-way swivel bracket attaching the ironing board to a main L-shaped bracket situated on the top of the dryer while also incorporating an attachment arm for a secure attachment to the side of a small stable object such as a dryer.

A further object of the present invention is to provide a portable ironing board which allows storage of the ironing board in a very small narrow space such that when the ironing board is stored within such narrow space it is held securely therein. The design further incorporates the ability to swing the ironing board out from said limited space while the attachment arm and two-way swivel bracket assembly remain securely affixed to the support object, said object preferably a dryer or the like. The ironing board may pivot onto the top of the dryer and then be used as a standard ironing board or folding table.

The present invention is directed towards a portable ironing board which has a two-way swivel bracket for the ironing board assembly and which allows the ironing board assembly to be securely affixed to the side of a dryer while also allowing the ironing board to be stored in a very small space located between the washer and dryer. The attachment arm for the ironing board assembly attaches to the underside of the dryer while also having a spring loaded clamp for tightening the entire assembly against the dryer while also having a tensioning mechanism for further secure tightening of the entire ironing board assembly to the side of the dryer. The two-way swivel bracket which attaches the ironing board to the ironing board assembly allows the ironing board to be swiveled outward from the vertical storage space between the washer and dryer, said swivel bracket also allowing the ironing board to be pivoted onto the top of the dryer after it is swung out from said vertical storage space.

Finally, the present invention comprises a portable ironing board, comprising: an L-shaped bracket; an attachment arm slidably mounted at one end to said L-shaped bracket and having a hook at the opposite distal end; swivel assembly means attached to said ironing board and said L-shaped bracket for swiveling said ironing board in two directions.

BRIEF DESCRIPTION OF THE DRAWINGS

A better understanding of the invention will be had upon reference to the following description in conjunction with the accompanying drawings in which the like numerals refer to like parts and wherein.

DETAILED DESCRIPTION OF THE PREFERRED EMBODIMENT

Figure 1:
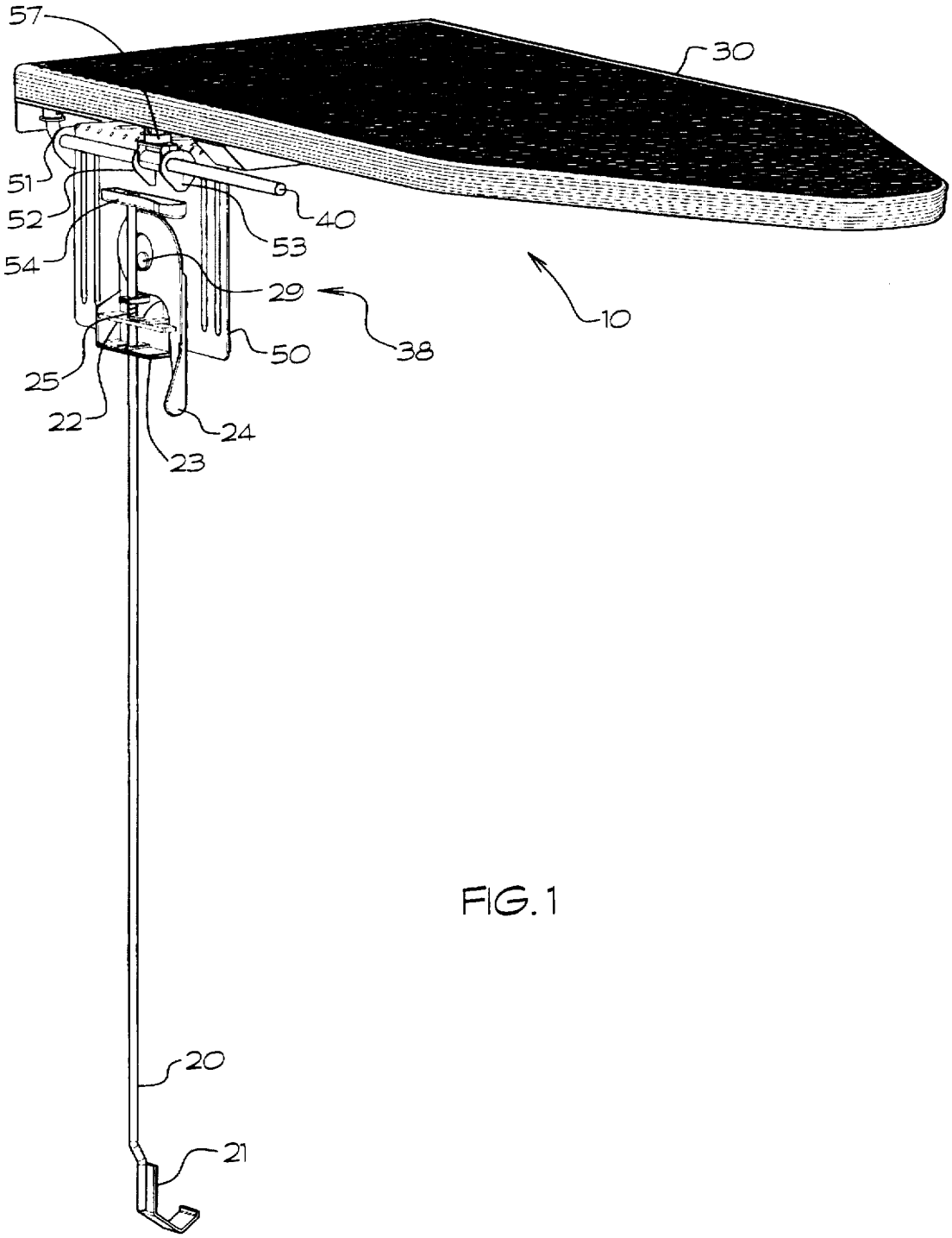
FIG. 1 is a perspective view of the two-way swivel bracket with ironing board assembly of the present invention.
Figure 4:
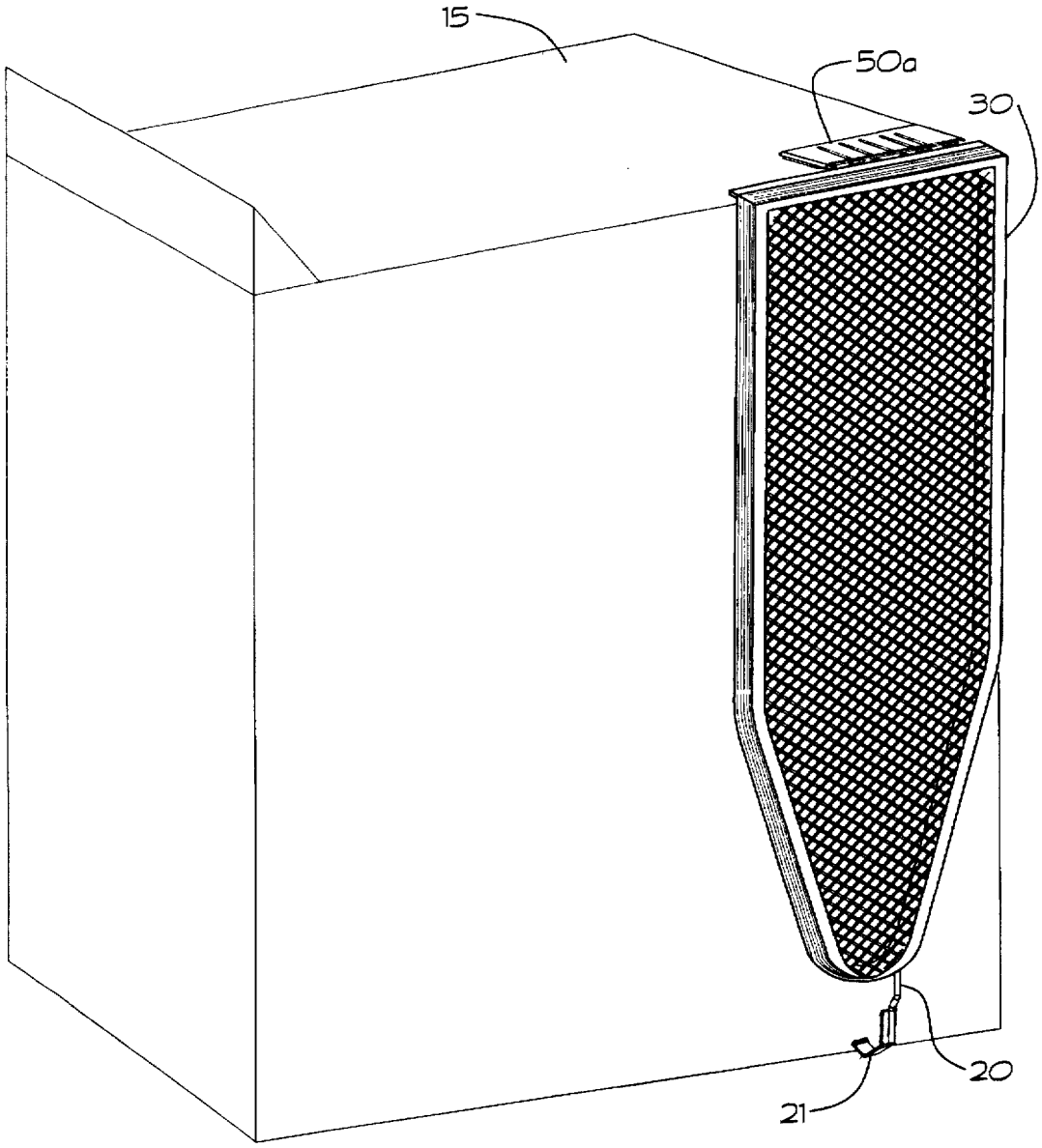
FIG. 4 is a perspective view of the ironing board of the present invention attached to the side of a dryer wherein the ironing board is in the stored position.
Figure 5:
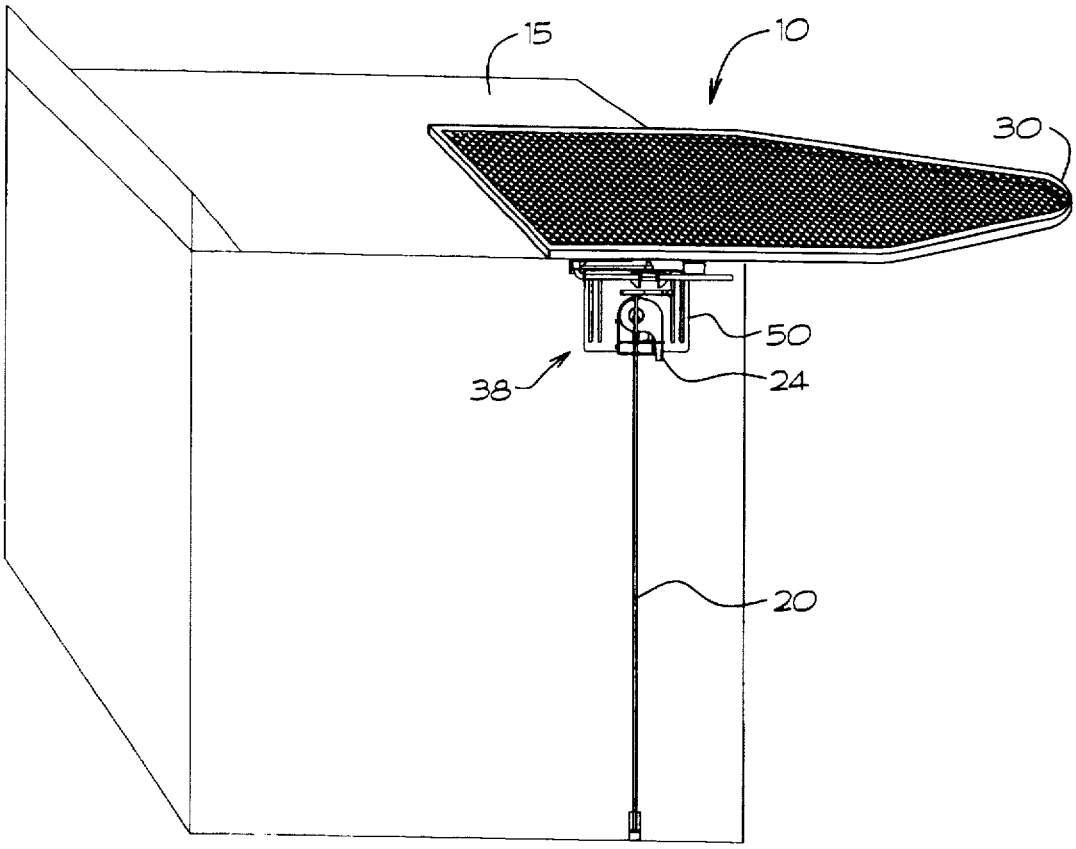
FIG. 5 is perspective view of the two-way swivel bracket with ironing board assembly of the present invention wherein the ironing board is extended in the operative position.

Referring to FIG. 1, the portable ironing board with two-way swivel bracket assembly 10 of the present invention is shown. The ironing board assembly 10 is comprised of an ironing board 30, an attachment assembly 38 and an attachment arm 20, said arm having at its distal end an attachment hook 21 for hooking the attachment arm 20 to the underside of a dryer. FIG. 4 shows the ironing board 30 attached to dryer 15 wherein the ironing board 30 is attached to the side, top and bottom edges of said dryer and is stored in the downward vertical position. The ironing board 30 is clamped to the dryer via attachment arm 20 and hook 21 such that L-shaped main bracket 50 compresses downward against the top edge or surface of the dryer assuring secure attachment of the entire assembly 10 to said dryer. FIG. 5 shows the same ironing board assembly 10 wherein the ironing board 30 is in the horizontal position extending outward from the top of dryer 15. Attachment assembly 38 is again shown more fully whereby attachment arm 20 and hook 21 are utilized to secure the ironing board 30 and main bracket 50 to the top of dryer 15. The ironing board may be stored in a narrow space as is shown in FIG. 4, such as between the washer and dryer in a normal laundry closet or the like of a home, and then extended outward into the horizontal position, as is shown in FIG. 5, for use as an ironing board or folding table. Attachment assembly 38 insures that the ironing board and main bracket 50 is securely affixed to the dryer as is shown in FIG. 5.

Returning now to more detail of the attachment assembly 38, in FIG. 1 the main components of the attachment assembly 38 are shown. Main L-shaped bracket 50 supports the ironing board 30 and the two-way swivel bracket assembly which is comprised of main bracket 50, shaft 40, guide block 57 and other structure which shall be discussed herein. Attachment arm 20 extends through the attachment assembly 38 to the bottom portion of the arm wherein attachment hook 21 is shown. Arm 20 is positioned through lock clamp 22 and guide post 23 such that main bracket 50, which contacts the top surface of dryer 15, is slidably attached to the attachment arm 20. Tensioning lever 24 is also provided to allow for short distance tightening of the attachment assembly to the dryer. Locking clamp 22 acts as a pinching clamp on shaft 20 and is forced downward into a non-perpendicular position relative to said shaft effecting such locking action by clamp spring 25. Cammed tensioning lever 24 is rotatably attached to main bracket 50 but is not attached to the bracket at lever's 24 center point. As can be seen in FIG. 1, rivet 29 rotatably affixes the tensioning lever 24 to main bracket 50 at an off center point, such that it acts as an eccentric, in order to allow tensioning lever 24 to tighten the clamping action of locking clamp 22 at shaft 20 by a total of one-quarter inch (3 cm). This mechanism will be discussed further herein. Also shown in FIG. 1 are first, second and third bracket guide sleeves 51, 52 and 53 which receive shaft 40 in order to provide both rotation and swiveling action of the ironing board 30 relative to main bracket 50.

Figure 2:
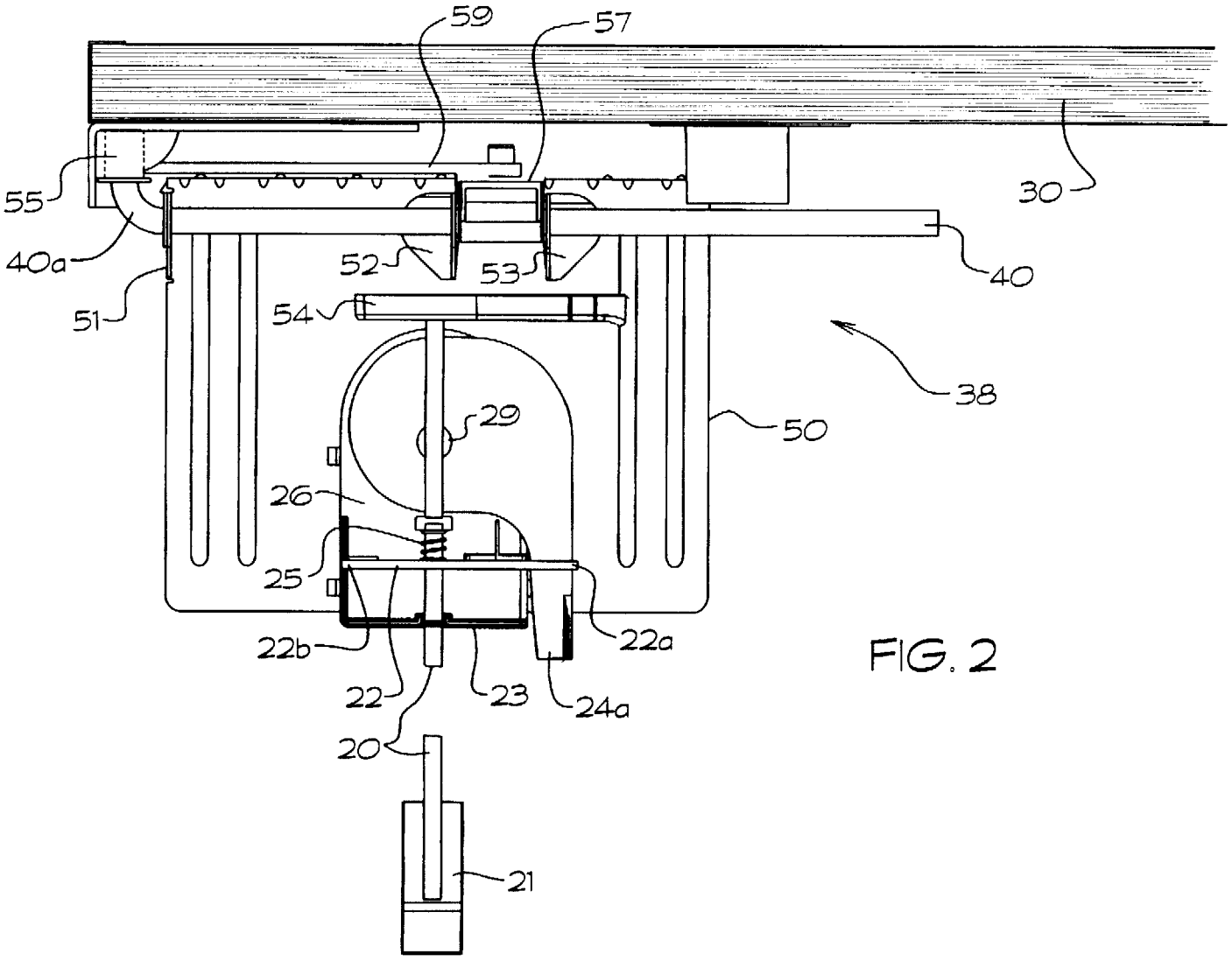
FIG. 2 is a side view of the two-way swivel bracket and ironing board assembly of FIG. 1.
Figure 10:
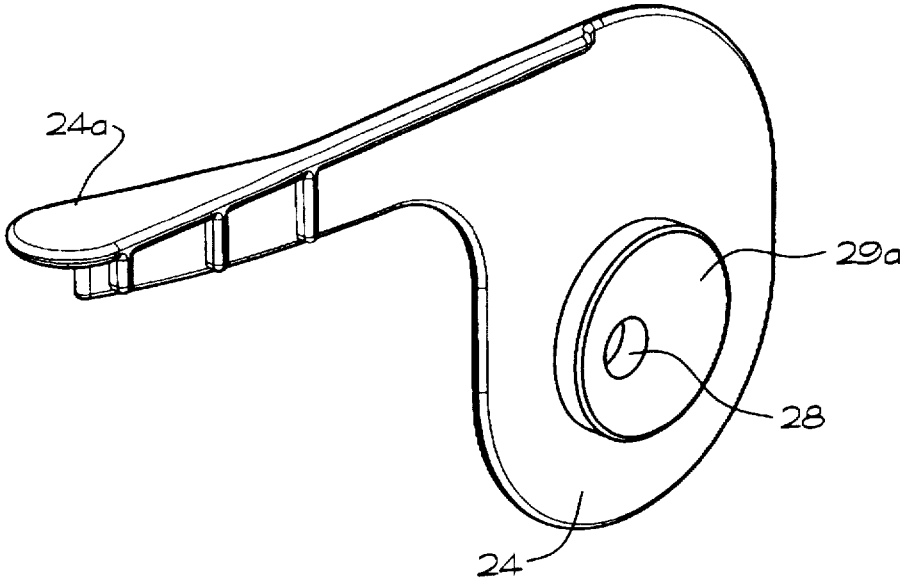
FIG. 10 is a close-up perspective view of the tensioner lever shown in FIG. 3.
Figure 10A:
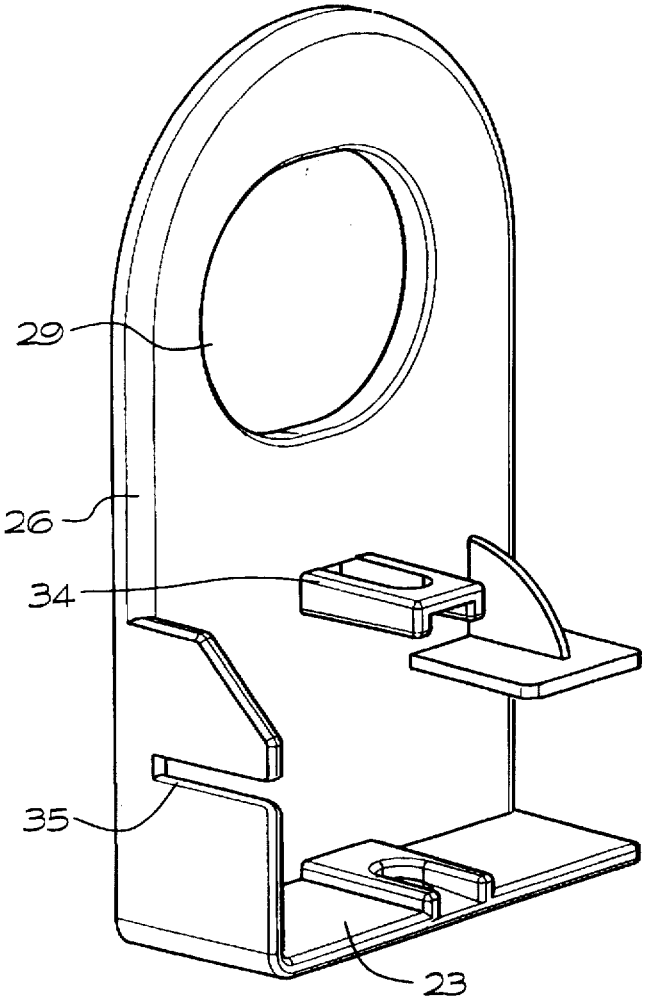
FIG. 10A is a close-up perspective view of the carriage which rotatably receives the tensioner lever and stores a locking clamp.

Shown in FIG. 2, the attachment assembly 38 is detailed more specifically. Ironing board 30 extends laterally above the attachment assembly 38, said ironing board 30 rotates or swivels about shaft leg **40*a* via rotation sleeve 55. The close-up of attachment assembly 38 details the ironing board in the horizontal position corresponding to FIG. 5. Shown in more detail is the tensioning lever 24 and the off center attachment of tensioning lever 24 to main bracket 50. Tensioning lever 24, shown more closely in perspective view in FIG. 10, has handle portion 24*a* and circular portion 29*a* extending outward from its side and having aperture 28 formed therethrough. Aperture 28 is not centrally formed within circular portion 29*a* such that lever 24, by rotating about aperture 28, acts as an eccentric providing upward force on shaft 20 as will be explained herein. As shown in FIG. 2, directly behind tensioning lever 24 is carriage 26, said carriage 26 shown more closely in perspective in FIG. 10A. Carriage 26 has formed at its upper portion aperture 29 for receiving circular portion 29*a* of lever 24. Also shown on carriage 26 in FIG. 10A is guide post 23 which slidably receives shaft 20 therethrough. While lever 24 rotates about rivet 29 which secures lever 24 and carriage assembly 26 to main bracket 50, the locking mechanism or locking means, comprised of carriage 26, lever 24, spring 25, locking clamp 22 and guide post 23, tightens arm 20 by pulling the arm 20 upwards with the carriage 26 when tensioning lever 24 is rotated in the clockwise direction, said upper movement caused by the eccentric and camming action of lever 24. Such clockwise rotation of tensioning lever 24 and handle portion 24*a* causes approximately a one-quarter inch (3 cm.) tightening movement of shaft 20 in the upwards direction thereby causing hook 21** to securely attach to the underside of a dryer.

Now turning back to FIG. 2, in explanation of the locking means for securing the shaft 20 to main bracket 50, shaft 20 extends upwards through carriage guide post 23, shown in FIG. 10A on the lower section of carriage 26, and continues through second guide post 34. Slot 35 receives locking clamp 22 as is shown in FIG. 2, above which on the attachment arm 20 is located clamp spring 25 which compresses against locking clamp 22 and second guide post 34 causing downward pressure on said locking clamp 22. Such downward pressure on lock clamp 22 causes the clamp to be at a non-perpendicular angle with said attachment arm 20 thereby preventing the downward movement of said attachment arm 20 through the aperture of said locking clamp. This effect is caused by the retention of end **22*b* of clamp 22 in carriage slot 35, said slot more clearly displayed in carriage 26 shown in FIG. 10**A.

At the upper end of attachment arm 20 is found handle 54. For use of said attachment arm 20 and in order to drop attachment arm 20 to its lowest most position for attachment to the bottom edge of a dryer, upper pressure is applied to end **22*a* of locking clamp 22 thereby allowing the attachment arm to pass through the aperture on locking clamp member 22 and through guide post 23. Typically, the gravitational weight of attachment arm 20 will provide sufficient downward force on locking clamp member 22 to ensure the locking mechanism of said clamp, however, spring 25 is provided to exert additional downward pressure on said locking clamp 22** to ensure the locking function.

To use the locking means shown in FIG. 2, L-shaped bracket 50 is placed along the side of a dryer and upward force is directed at the end of locking clamp 22 at position 22*a*. Hook 21 and attachment arm 20 thereby drops to its farthest downmost position. Upward pressure is then applied to handle 54 to raise hook and attachment arm into secure position. Subsequently, tensioning lever 24 is rotated by clockwise rotation on handle portion 24*a* thereby raising attachment arm 20 approximately one-quarter inch (3 cm.) until tensioning lever 24 and handle 24*a* is in the fully extended position as is shown in FIG. 2. The upward action of approximately one-quarter inch (3 cm.) tightens assembly 10 onto dryer 15.

Also shown in FIG. 2 is the shaft 40 and guide block 57 which allow the rotational and pivoting action of the ironing board about the axis of shaft 40 and about rotation sleeve 55. Such two-way swiveling or rotational action of the ironing board 30 will be discussed more fully herein. When the ironing board is in the vertical stored position as corresponds to FIG. 4, the upper surface of ironing board 30 covers the entire attachment assembly 38, except for the top member 50*a* of the main bracket 50.

Figure 3:
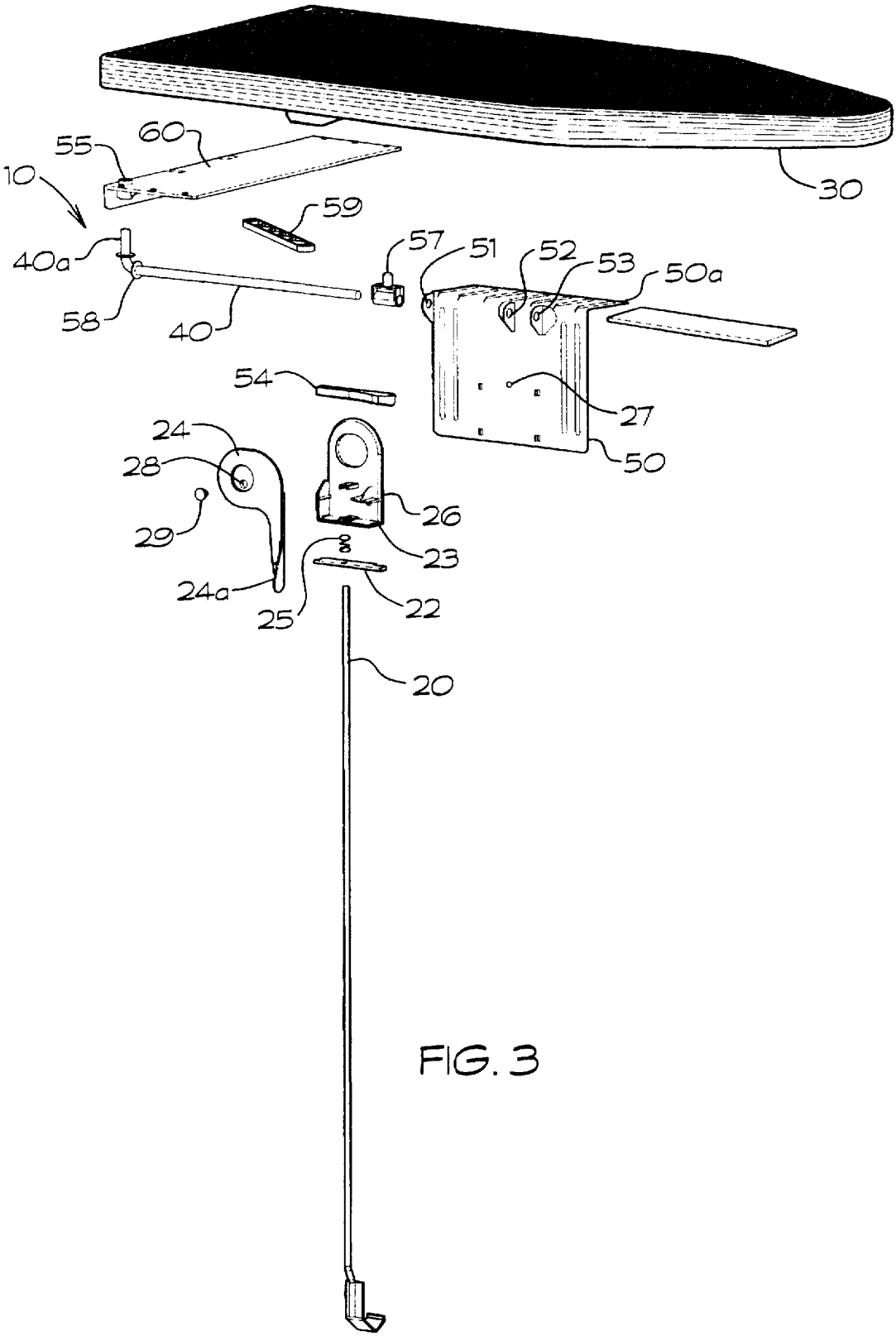
FIG. 3 is a perspective exploded view of the two-way swivel bracket with ironing board assembly of the present invention.

Turning now to FIG. 3, an exploded view of the ironing board with two-way swivel bracket assembly 10 is shown. Ironing board 30 is securely affixed to attachment platform 60. Platform 60 has, at one corner, rotation sleeve 55 for receiving shaft leg 40*a*. Shaft leg 40*a* and rotation sleeve 55 allow the ironing board to swivel about shaft leg 40*a* by the rotatable connection of shaft leg 40*a* into rotation sleeve 55.

Also shown in FIG. 3 is connecting arm 59 which is additionally rotatably attached to the underside of attachment platform 60 while also being rotatably attached to guide block 57. Connecting arm 59 acts to limit the amount of rotation platform 60 has about sleeve 55 and leg 40*a* in the counter-clockwise direction and provides a stabilizing path of travel for said rotation. As will be readily seen below, rotation of the ironing board 30 and attachment platform 60 about the pivot point defined as sleeve 55 causes shaft 40 to slide axially within first, second and third bracket guide sleeve 51, 52, 53 formed on main bracket 50. As rotation about sleeve 55 continues, sleeve 55, the point of rotation, move axially along the path of travel of shaft 40. Thus, the pivot point or rotational center moves while rotation occurs. Connecting arm 59 additionally causes alignment of the ironing board 30 in relation to main bracket 50 and the dryer onto which it is affixed.

Also shown in FIG. 3 is guide block 57 which has centrally formed therethrough a sleeve for receiving shaft 40. Guide block 57 is located between second bracket guide sleeve 52 and third bracket guide sleeve 53. By including guide block 57 between sleeves 52 and 53, the rotation of the ironing board 30 and platform 60 about an axis defined by the shaft 40 wherein shaft 40 is rotated within sleeve members 51, 52 and 53, is made more efficient by including rotation of the arm 59 and the entire attachment assembly about said axis. Ironing board 30 as well as attachment platform 60 swivels or rotates around the longitudinal axis of said shaft 40. Such motion allows the ironing board to be rotated from the horizontal position to a vertical position allowing said ironing board to be stored in a narrow storage slot.

Figure 6:
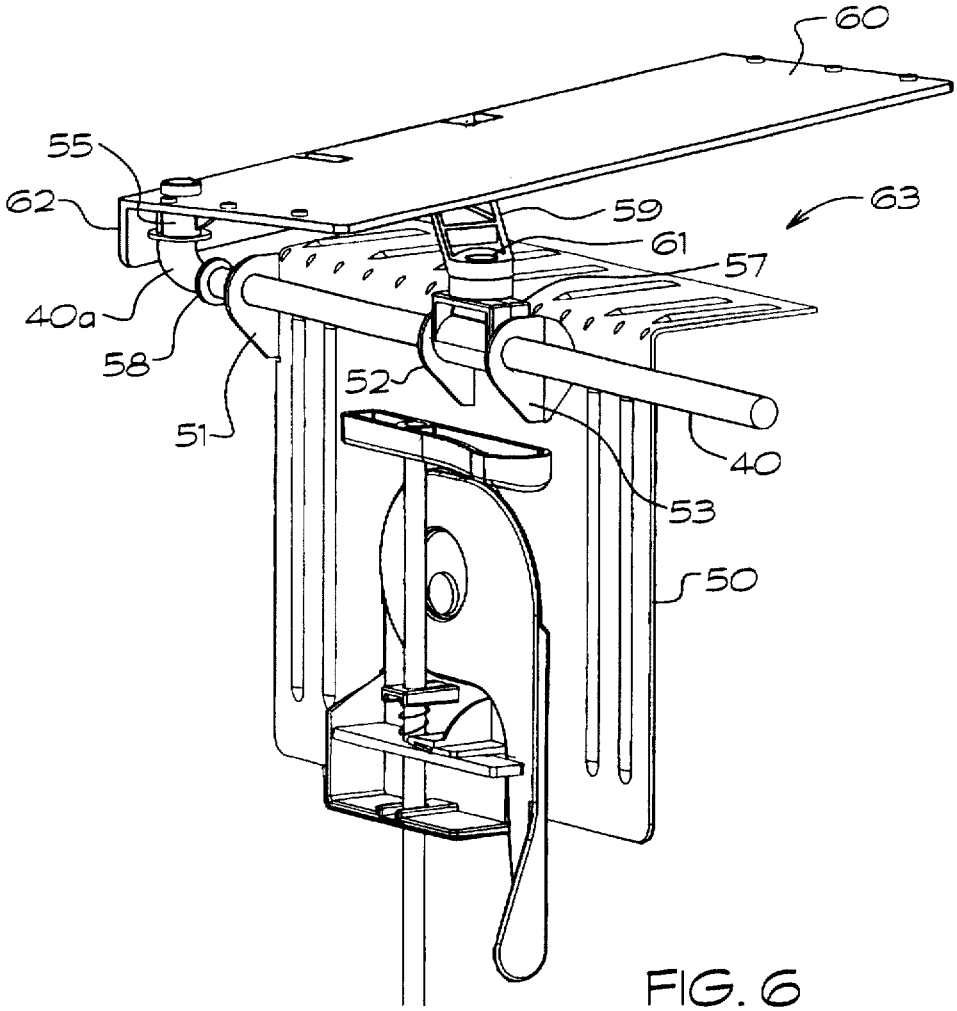
FIG. 6 is close-up perspective view of the two-way swivel bracket of the present invention.

FIG. 6 shows swivel assembly 63 and the two-way swiveling action of the ironing board 30 and platform 60. The ironing board 30 is not shown in FIG. 6, FIG. 7 and FIG. 8 for ease of discussion. However, the ironing board in normal application will be affixed to attachment platform 60 and would extend outward from left to right. Shown in FIG. 6 and comprising swivel assembly means 63 are attachment platform 60, shaft 40, connecting arm 59, guide block 57, first, second and third guide sleeves 51, 52, and 53, rotation sleeve 55, and main bracket 50. Shown in FIG. 6, the ironing board is placed in the horizontal position corresponding to that shown in FIG. 5. Attachment platform 60 may be swiveled or rotated in clockwise fashion about rotation sleeve 55 causing shaft 40 to move from right to left through sleeves 51, 52 and 53 as is shown in FIG. 6. Connecting arm 59 is also rotatably attached to guide block 57 by rotational attachment pin 61 and a similar attachment on the underside of the attachment platform 60. Circular stop member 58 is formed on shaft 40 to define a fully extended or open position for the counter-clockwise rotation of platform 60 and corresponding ironing board 30 about sleeve 55 to place ironing board 30 in the useful horizontal position. As platform 60 is rotated about rotation sleeve 55 via leg 40*a* in the counter-clockwise direction, shaft 40 extends through first, second and third bracket guide sleeves 51, 52 and 53 until such time as circular stop member 58 abuts directly against first bracket guide sleeve 51. This position generally corresponds to the position, as previously stated, of the ironing board 30 shown in FIG. 5.

The swivel assembly 63, shown in FIG. 6, corresponds to the ironing board placed in the horizontal position, again as shown in FIG. 5. The ironing board and the swivel assembly 63 are securely affixed to the side of the dryer by the attachment assembly 38, previously discussed, via attachment arm 20 and hook 21. The lower portion of the attachment assembly 38 as previously described is not shown in FIG. 6, 7 and 8 in order to clearly show the structure and functionality of the two-way swivel assembly 63. As previously stated, for the ironing board to be in the proper horizontal position, attachment platform 60 is rotated about rotation sleeve 55 and shaft leg 40*a* until circular stop member 58 abuts against first bracket guide sleeve 51. To place the ironing board in the stored vertical position, attachment platform 60 is rotated upwards in a counter-clockwise direction relative to the longitudinal axis of shaft 40. Such rotation causes shaft 40, connecting arm 59 and guide block 57 to rotate in the counter-clockwise direction relative to the longitudinal axis of shaft 40. Rotation of the ironing board and attachment platform 60 into such position does not cause any sliding action of shaft 40, only rotation of shaft 40 within bracket guide sleeves 51, 52 and 53.

Figure 7:
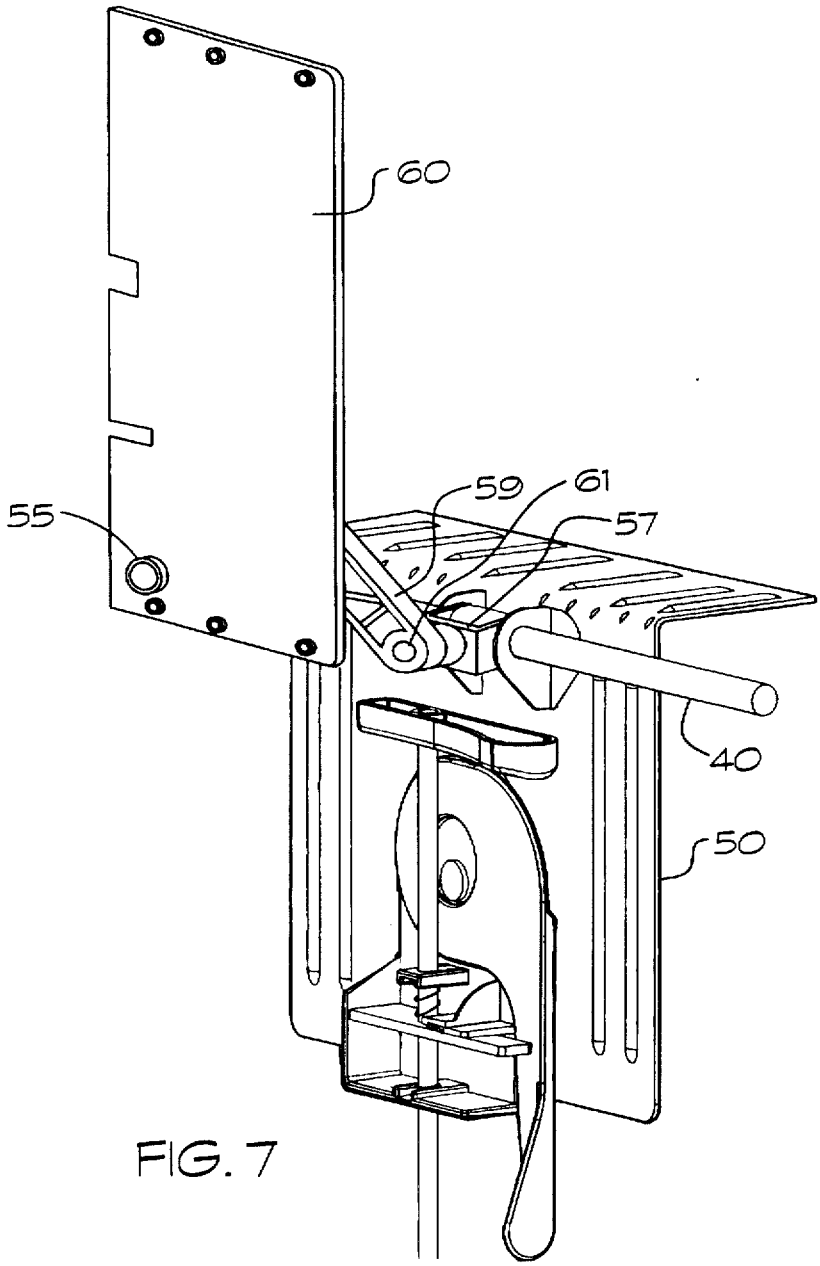
FIG. 7 is a close-up of the two-way swivel bracket of FIG. 6 wherein the ironing board is pivoted to the vertical position.

Once ironing board and attachment platform 60 is in the vertical position with the end of the ironing board extending outward toward the front of the dryer corresponding to FIG. 7, the platform 60 and ironing board must now be rotated downward, in the clockwise direction relative to a point defined by rotation sleeve 55. This allows the ironing board 30 to be situated in the stored position in between the washer and dryer as would be the case in most circumstances. Rotation of the attachment platform 60 in the clockwise direction causes shaft 40 to slide through first, second and third bracket guide sleeves 51, 52 and 53 in the right to left direction all the while keeping rotation sleeve 55 in the same plane as the shaft 40. This sliding action, however, causes the sleeve 55 to move from right to left along the shaft 40 axis. To achieve this, while platform 60 is rotated about rotation sleeve 55, connecting arm 59 also rotates downward or counter-clockwise about rotational attachment pin 61 on guide block 57. This movement is shown more clearly in FIG. 8. Connecting arm 59 during the rotation of the ironing board and attachment platform 60 into the downward position eventually moves arm 59 to a position parallel to shaft 40. During rotation, shaft 40 moves from right to left through sleeve 51, 52 and 53. Upon complete rotation of platform 60 to the stored position, rear ledge 62, shown more clearly in FIG. 6, contacts connecting arm 59 thereby discontinuing rotation of the ironing board 30 and platform 60 about rotation sleeve 55. At such position, as corresponds to FIG. 4, the ironing board is in the vertical stored position extending downward in between the dryer and washing machine. When the ironing board is in said vertical stored position as is displayed in FIG. 4, rear ledge 62 of platform 60 rests against connecting arm 59 thereby stabilizing ironing board 30 and platform 60 in the vertical position. Thus, when in such position, continued movement in the clockwise direction about sleeve 55 is prevented. In order to place the ironing board again in the horizontal position, the reverse steps are performed, namely, the ironing board is swiveled counter-clockwise about rotation sleeve 55 causing shaft 40 to extend from left to right through sleeves 51, 52 and 53. Once circular stop member 58 abuts directly against first bracket guide sleeve 51, the ironing board 30 and attachment platform 60 are rotated clockwise about the longitudinal axis of shaft 40 allowing the board 30 to rest against the top of dryer 15.

Figure 8:
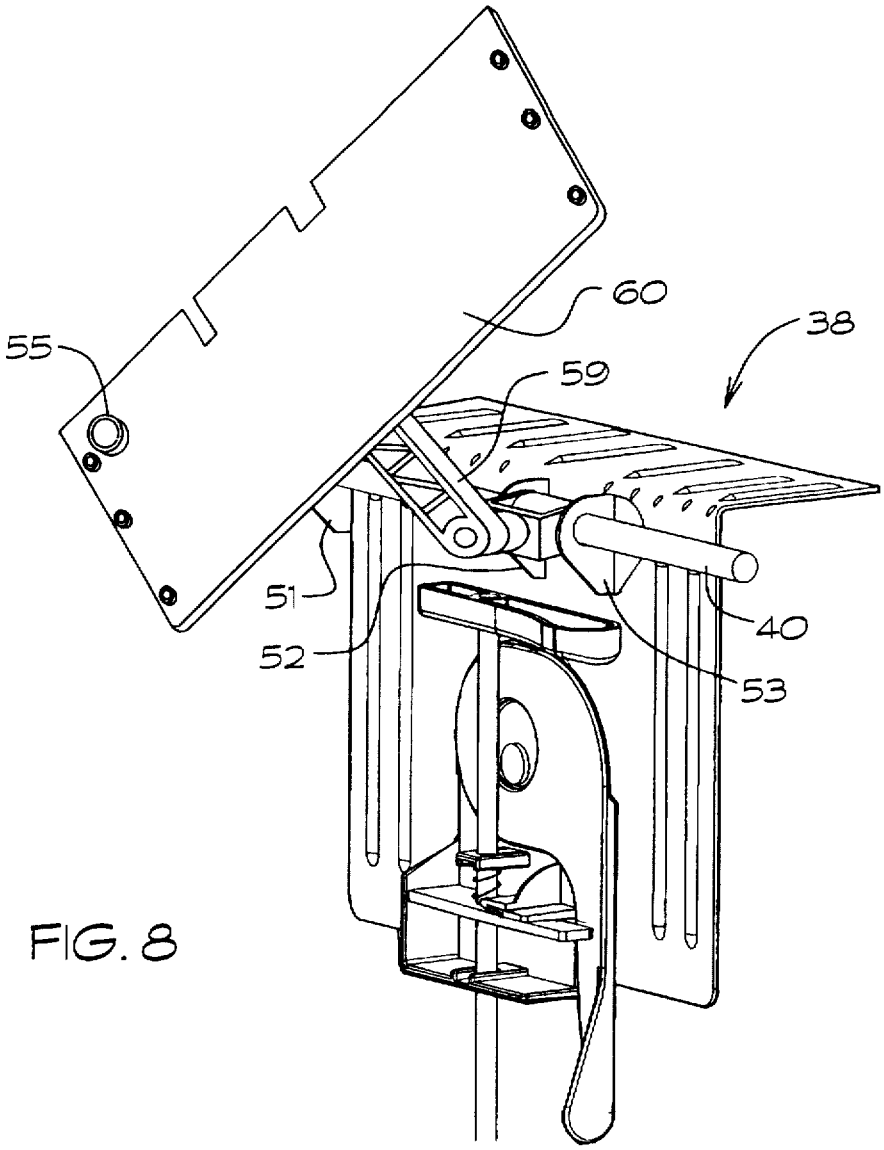
FIG. 8 is a close-up side view of the swivel bracket of FIG. 6 wherein the ironing board is being rotated into the storage position.
Figure 9:
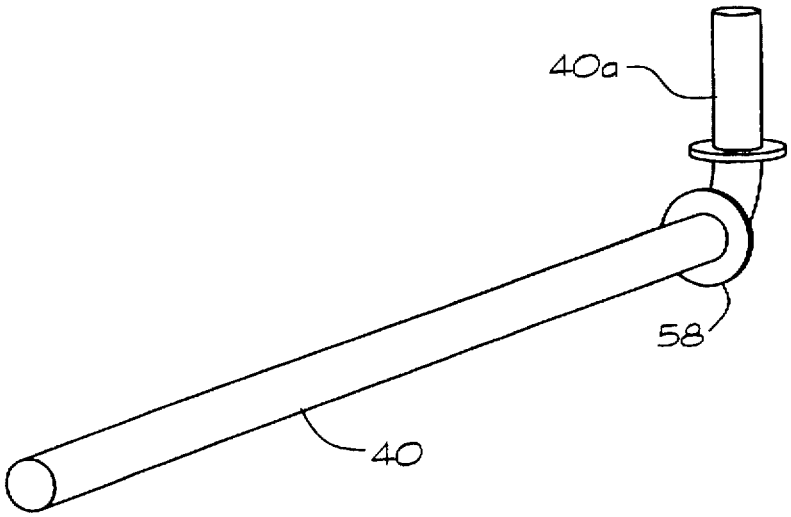
FIG. 9 is a perspective view of the bracket shaft shown in FIG. 6.
Figure 9A:
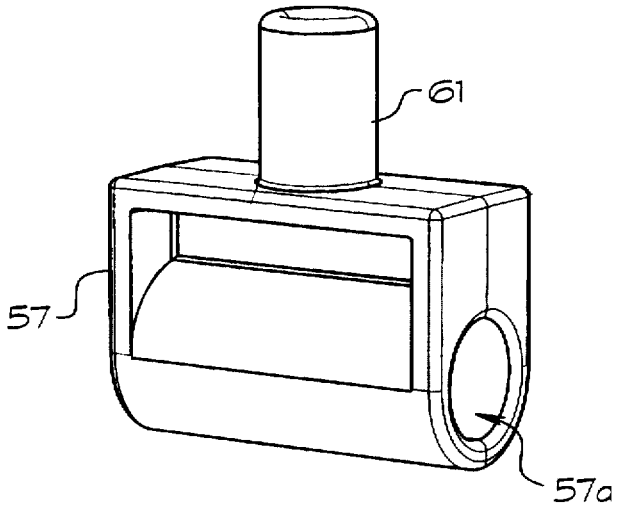
FIG. 9A is a perspective view of the guide block which is rotatably mounted on the bracket shaft of FIG. 9.

Shown in FIG. 9A is the guide block 57 and attachment pin 61 which extends through an aperture on attachment arm 59 as is shown in FIGS. 6, 7 and 8. Guide block 57 has sleeve 57*a* through which shaft 40 extends through. Guide block 57 is bounded on opposite sides by guide sleeves 52 and 53 as is shown in FIG. 8. Inclusion of guide block 57 in the design of swivel assembly 63 allows the dual rotation previously described whereby the ironing board may be rotated about two separate axis.

The novel swivel assembly 63, disclosed herein, allows rotation of the ironing board about two axis, the first being around the rotation sleeve 55, the second being rotation about the axis of shaft 40. Previous attachment brackets would not allow rotation about two separate axis thereby preventing the ability of storage of an ironing board in small or narrow storage area such as is accomplished in the present invention.

Shown in FIG. 9, the shaft 40 and shaft leg 40*a* are shown without any other structure. Shaft leg 40*a*, as previously indicated, is inserted into rotation sleeve 55 of the attachment platform 60. Shaft 40 extends through first, second and third bracket guide sleeves 51, 52 and 53. Circular stop member 58 is permanently formed at a position adjacent the elbow of shaft 40 and shaft leg 40*a* to indicate the maximum rotation of the ironing board and attachment platform about rotation sleeve 55.

Figure 11:
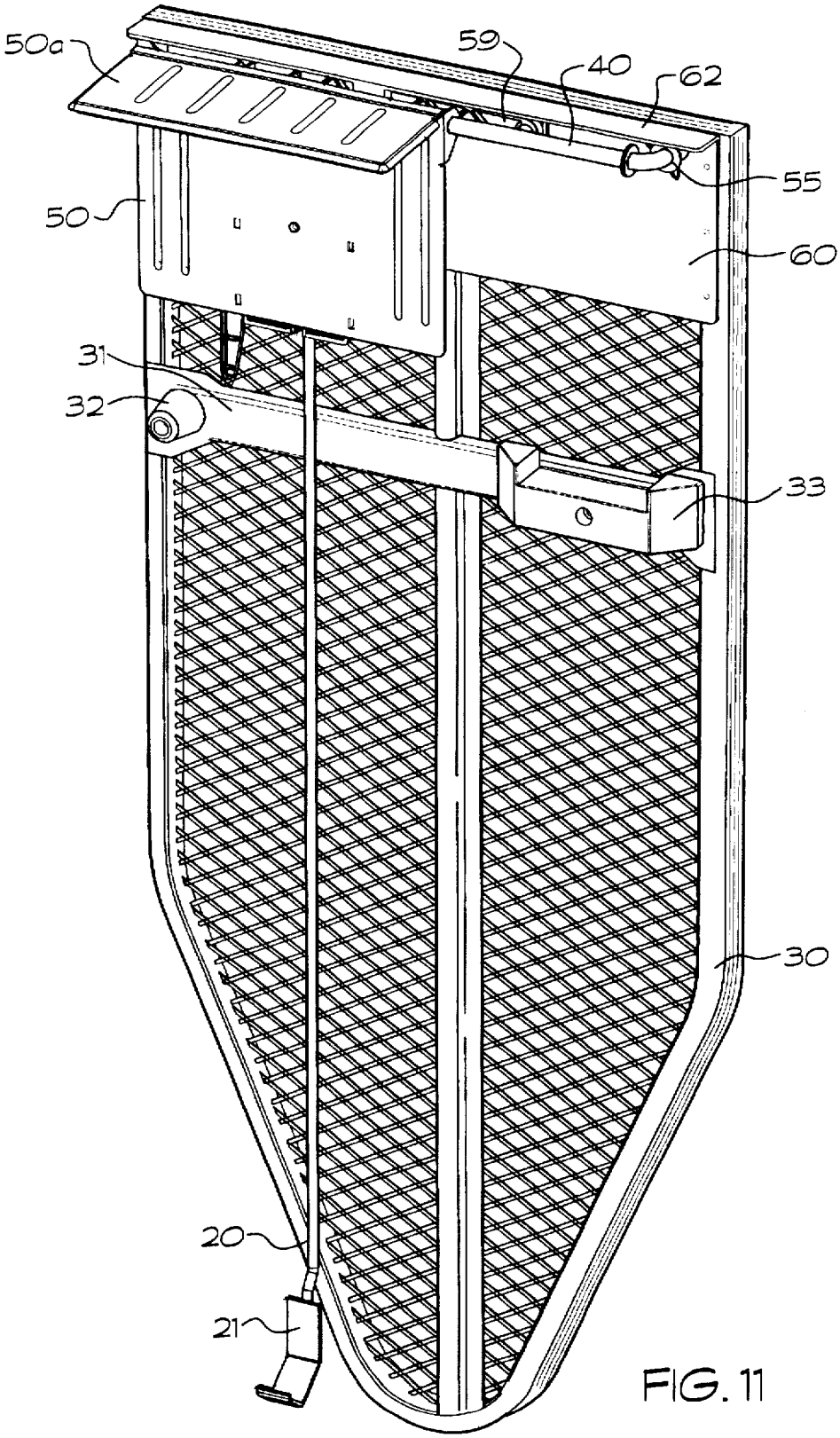
FIG. 11 is a perspective view of the two-way swivel bracket with ironing board assembly of the present invention wherein the ironing board is in the vertical stored position; and, FIG. 12 is a perspective view of the underside of the ironing board of the present invention.

Turning to FIG. 11, a perspective view of the underside of the ironing board and the main bracket 50 is shown. Attachment arm 20 extends downward from the attachment assembly 38 ending at hook 21. Ironing board 30 is comprised of a center support member 31 and bumper 32, as well as mid-section support 33. Bumper 32 and support member 33 act to provide support and stability to the ironing board along the shoulder portion of said board when the ironing board 30 is placed in the horizontal position on the top of the dryer 15. Main bracket 50 is also shown as well as attachment platform side member 62. When ironing board is in the downward vertical position as is shown in FIG. 11, side member 62 abuts against connecting arm 59 thereby preventing any further downward rotation.

Figure 12:
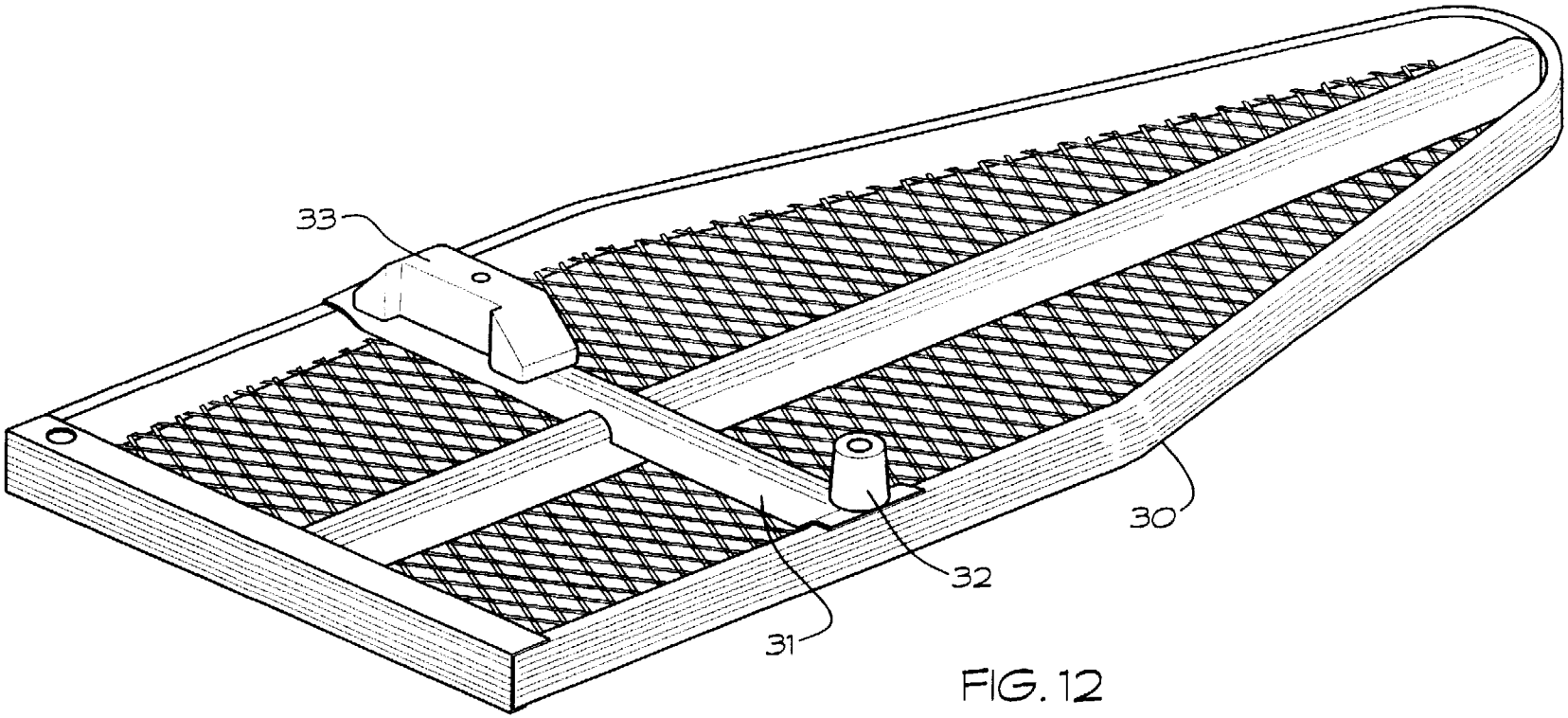

Finally, as shown in FIG. 12, the underside of the ironing board 30 is displayed with center section, bumper 32 and support member 33 which is utilized to provide sufficient stabilization and support of the ironing board when placed in the horizontal position.

Discussions of use of the ironing board with two-way swivel bracket assembly 10 has focused upon use in connection with a dryer. However, one of ordinary skill in the art will no doubt be aware that use of the assembly with any stable object is possible, such as a counter top, movable storage shelf or any structure which would receive the bracket and attachment arm of the present invention.

The foregoing detailed description is given primarily for clearness of understanding and no unnecessary limitations are to be understood therefrom for modifications will be become obvious to those skilled in the art upon reading this disclosure and may be made without departing from the spirit of the invention or the scope of the appended claims.

What is claimed is:

1. A portable ironing board, comprising:

an L-shaped bracket;

an attachment arm slidably mounted at one end to said L-shaped bracket and depending therebelow and having a hook at the opposite distal end;

swivel assembly means attached to said ironing board and said L-shaped bracket for swiveling said ironing board in two directions.

2. The ironing board of claim 1 further comprising locking means mounted on said L-shaped bracket to slidably secure said L-shaped bracket to said attachment arm.

3. The ironing board of claim 2 wherein said locking means is comprised of a locking clamp acting upon said attachment arm.

4. The ironing board of claim 2 wherein said locking means is further comprised of a camming tensioning lever, said tensioning lever rotatably attached to said L-shaped bracket and eccentrically attached to said locking means raising said locking means and said attachment arm when rotated.

5. The ironing board of claim 1 wherein said swiveling assembly means is further comprised of:

a shaft rotatably retained on said L-shaped bracket by at least one guide sleeve, said shaft having a shaft leg extending 90 degrees from said shaft at one end;

said shaft rotatably attached to said ironing board at said shaft leg by a rotation sleeve;

whereby, said ironing board swivels in a first direction about an axis defined by said shaft and swivels in a second direction about a point defined by said rotation sleeve such that rotation about said rotation sleeve causes said shaft to slide axially through said at least one guide sleeve.

6. The ironing board of claim 5 wherein said shaft has a circular stop member adjacent said shaft leg.

7. The ironing board of claim 5 further comprising:

a first, second and third guide sleeve formed on said L-shaped bracket;

a guide block rotatable on said shaft and retained between said second and third guide sleeve;

a connecting arm rotatably attached to said guide block and rotatably connected to the underside of said ironing board;

such that said connecting arm maintains said rotation sleeve on an axis parallel to said shaft.

8. The ironing board of claim 4 wherein said locking means is further comprised of:

a carriage having a guide post, said guide post having an aperture through which said attachment arm extends, said carriage having an aperture which rotatably receives said tensioning lever;

a locking clamp retained within said carriage and having an aperture through which said attachment arm extends;

whereby clockwise rotation of said tensioning lever causes said carriage to move upwards about one quarter inch.

9. A portable rotatable ironing board, comprising:

an attachment arm, said arm having at one distal end a hook;

an L-shaped bracket slidably attached to said attachment arm;

locking means attached to said L-shaped bracket for slidably locking said arm to said L-shaped bracket; and, swivel assembly means attached to said L-shaped bracket for rotatably attaching an ironing board to said L-shaped bracket.

10. The ironing board of claim 9 wherein said swivel assembly means further comprises at least one bracket guide sleeve mounted on said L-shaped bracket, said at least one sleeve receiving a shaft on a plane perpendicular to said attachment arm, said shaft rotatably attached to said ironing board.

11. The ironing board of claim 10 wherein said swivel assembly means further comprises:

a first, second and third bracket guide sleeve mounted on said L-shaped bracket;

a guide block rotatably mounted on said shaft between said second and third bracket guide sleeve;

a connecting arm rotatably connected to said guide block and the underside of said ironing board.

12. The ironing board of claim 11 wherein said shaft further comprises a circular stop member formed on said shaft.

13. The ironing board of claim 9 wherein said locking means further comprises:

a carriage having a first and second guide post for receiving said attachment arm;

a locking clamp mounted between said first and second guide post on said carriage;

a clamp spring wrapped around said attachment arm and compressing against said second guide post and said locking clamp.

14. The ironing board of claim 13 wherein said locking means further comprises:

a tensioning lever rotatably mounted on said L-shaped bracket and having an outwardly extending circular member;

wherein said carriage has an aperture for receiving said circular member of said tensioning lever; and, said tensioning lever mounted on said L-shaped bracket in eccentric fashion such that clockwise rotation of said lever raises said carriage.

15. The ironing board of claim 14 wherein said tension lever raises said carriage about one quarter inch.

16. The ironing board of claim 9 wherein said ironing board has a bumper and support member on the underside of said ironing board.

17. The ironing board of claim 9 wherein said attachment arm has a handle at the opposite distal end of said hook.

18. A portable and rotatable ironing board, comprising:

an L-shaped bracket;

an attachment arm slidably attached to said L-shaped bracket;

an attachment assembly affixed to said L-shaped bracket, said attachment arm extending through said attachment assembly;

a locking clamp slidably mounted on said attachment arm and retained on said attachment assembly; and, a swivel assembly rotatably mounted on said L-shaped bracket and affixed to an ironing board.

19. The ironing board of claim 18 wherein said attachment arm has a handle at one distal end and a hook at the opposite distal end.

20. The ironing board of claim 18 wherein said attachment assembly is further comprised of a carriage, said carriage having:

a first and a second guide post for receiving said attachment arm;

wherein said locking clamp is held on said carriage;

a clamp spring around said attachment arm and retained between said second guide post and said locking clamp; and, a cammed tensioning lever rotatably mounted on said L-shaped bracket, said carriage affixed between said tensioning arm and said bracket.

21. The ironing board of claim 18 wherein said swivel assembly is further comprised of:

a shaft;

a plurality of bracket guide sleeves for rotatably receiving said shaft;

said shaft having a shaft leg which is rotatably attached to said ironing board.

22. The ironing board of claim 21 further comprising:

a guide block rotatably mounted on said shaft and retained between said bracket guide sleeves;

a connecting arm rotatably attached to said guide block and rotatably attached to the underside of said ironing board;

whereby said ironing board is rotatable about said shaft leg and is rotatable about the longitudinal axis of said shaft.

23. A two-way swivel bracket, comprising:

a bracket mounting having a plurality of bracket guide sleeves mounted thereon;

a shaft rotatably received in said bracket guide sleeves;

said shaft having a shaft leg extending outward from said shaft;

an attachment platform rotatably attached to said shaft leg;

a guide block rotatably retained on said shaft; and, a connecting arm rotatably affixed to said guide block at one end and rotatably affixed to said attachment platform at the opposite end.

24. The bracket of claim 23 further comprising:

a first, second and third bracket guide sleeves for rotatably receiving said shaft, said guide sleeves allowing said shaft to rotate within said sleeves and move axially within said sleeves.

25. The bracket of claim 23 further comprising:

a rotation sleeve mounted between said attachment platform and said shaft leg.

* * * * *